US007077207B2

(12) United States Patent
Stark et al.

(10) Patent No.: US 7,077,207 B2
(45) **Date of Patent: *Jul. 18, 2006**

(54) DOUBLE-CONE DEVICE AND PUMP

(75) Inventors: John Stark, Wattenwyl (CH); Hansjörg Wagenbach, Biel (CH); Jörg Schär, Münchenbuchsee (CH)

(73) Assignee: DCT Double-Cone Technology AG (CH)

( * ) Notice: Subject to any disclaimer, the term of this patent is extended or adjusted under 35 U.S.C. 154(b) by 232 days.

This patent is subject to a terminal disclaimer.

(21) Appl. No.: 10/472,130

(22) PCT Filed: Mar. 5, 2002

(86) PCT No.: PCT/CH02/00134

§ 371 (c)(1),
(2), (4) Date: Oct. 30, 2003

(87) PCT Pub. No.: WO02/075109

PCT Pub. Date: Sep. 26, 2002

(65) Prior Publication Data

US 2004/0104023 A1 Jun. 3, 2004

(30) Foreign Application Priority Data

Mar. 16, 2001 (EP) ..... 01810262

(51) Int. Cl.
*F15C 1/18* (2006.01)

(52) U.S. Cl. ..... 166/369; 166/105; 137/842

(58) Field of Classification Search ..... 166/369, 166/68.5, 105; 137/803, 842
See application file for complete search history.

(56) References Cited

U.S. PATENT DOCUMENTS

| | | | | |
|---|---|---|---|---|
| 4,603,735 | A | 8/1986 | Black | |
| 4,792,284 | A | 12/1988 | Straub et al. | |
| 5,488,993 | A | 2/1996 | Hershberger | |
| 6,701,960 | B1 * | 3/2004 | Stark et al. | 137/842 |

FOREIGN PATENT DOCUMENTS

| | | |
|---|---|---|
| EP | 001243748 A1 * | 9/2002 |
| WO | WO 01 16493 | 3/2001 |

* cited by examiner

*Primary Examiner*—William Neuder
(74) *Attorney, Agent, or Firm*—Ostrolenk, Faber, Gerb & Soffen, LLP

(57) ABSTRACT

The performance of a double-cone device (1) is increased, not only by moving the gap or inlet openings (22) a short distance into the exit cone (47), but also by making the conicity $\theta_3$ (55) of the so-formed small diffuser less than the conicity $\theta_2$ (109) of the remaining part (53) of the exit cone. Double cone units (7, 60), particularly the ones with this improved diffuser, may be used in pump installations (1, 60), like well-pumps (1), where liquids must be pumped from great depths.

19 Claims, 5 Drawing Sheets

DOUBLE-CONE DEVICE AND PUMP

Figure 1:
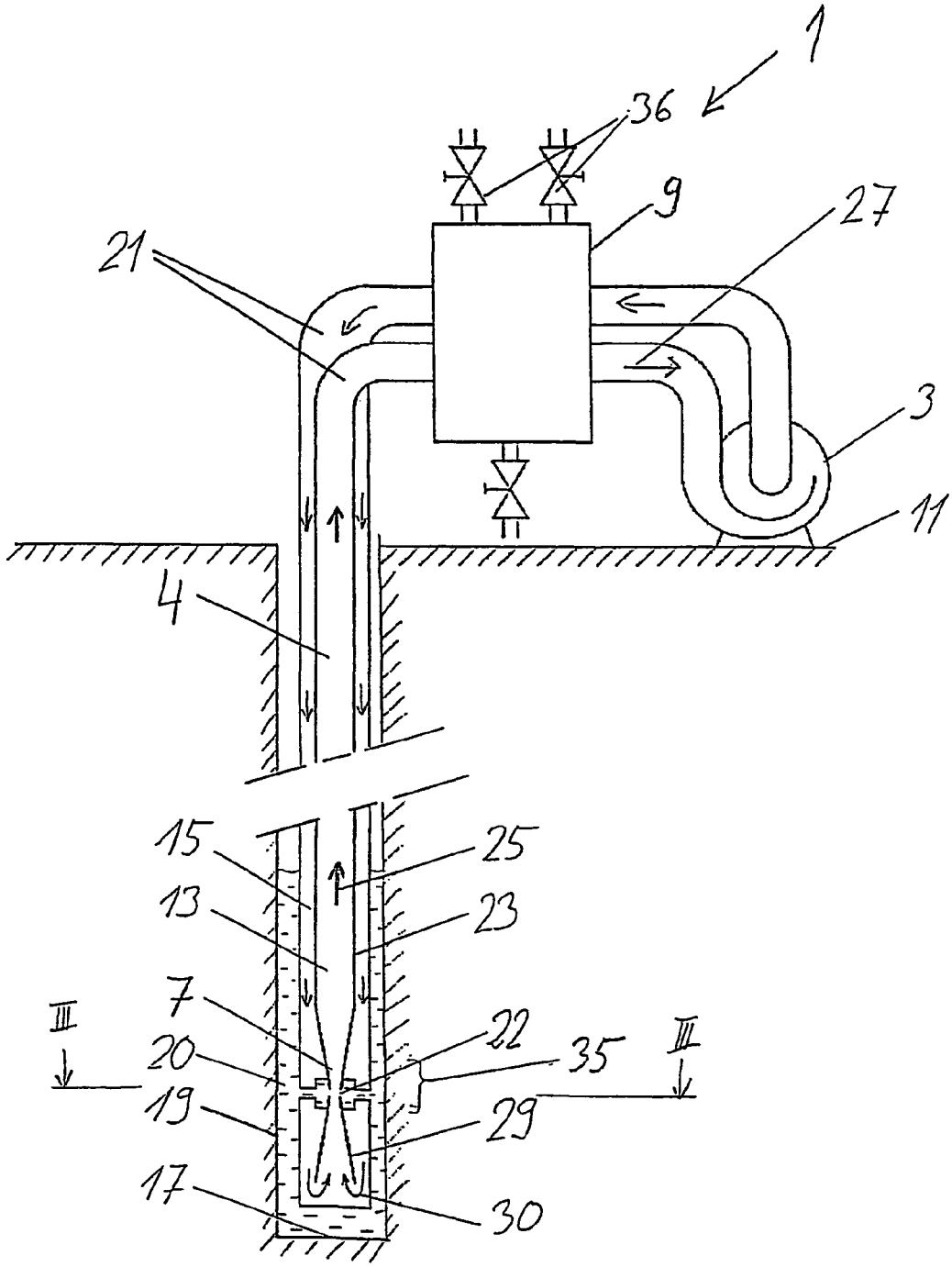

The present invention relates to a double-cone unit (DCT unit) according to the preamble of claim 1. It further relates to a pump comprising a double-cone unit according the preamble of claim 5.

The problem of pumping material from the bottom of wells whose depth below the surface is 10 or more meters is of widespread interest. Many underground water supplies are in the region of 20 to 150 meters below the surface and, as such, require positive pressure pumping techniques. In the petroleum industry the situation for some oil and gas wells is even more problematic in that they can be more than a kilometer deep.

Apart from the deep-well problem, another situation is coming into discussion. This new question concerns the raising of water from very great depths. Such water has been shown to possess very special properties and at depths of several kilometers contains a high percentage of heavy water. This natural resource is the principal raw fuel for the JET-fusion process.

At present there are a number of well-pumping techniques available on the market. Among these techniques, three appear to dominate. They are as follows:

An electric pump lowered to the bottom of the well.

A jet pump lowered to the bottom of the well.

Gas-lift techniques.

The lowering of an electric pump has many disadvantages. Most wells have a relatively small cross section, especially if they are deep, and as such, the pump rotor has to have a very small diameter. This fact severely limits the torque that the pump can develop and is only partially off-set by the use of very special costly materials. Further, the media to be pumped has to flow past the rotor; otherwise there is no cooling effect. At present, the only way to get power to such a pump is via an electric cable, which has to descend the full length of the well. Consequently, this type of pump is of very little use in the well sector of the petroleum industry, where the environment at the bottom of the well can include multi-phase acidic mixtures at high temperatures.

The jet pump is a notoriously inefficient device that cannot work against a high backpressure. However, it does have the advantage that the mechanical pump sits at the surface, out of harm's way. On the down side, this pump has to deliver the full pressure required to oppose the static and dynamic pressure-drop imposed by the depth of the well. In order to try and alleviate the need for such high-pressure deliveries, the gas-lift technique is often applied. This requires injecting gas at the bottom of the well, so that, on rising up the exhaust supply tube, the gas compensates to some extent the backpressure.

All these techniques work in theory, but prove to be very troublesome and costly in practice.

Therefore, one objective of the present invention is to provide a pumping device which overcomes at least one of the drawbacks set forth above.

Such a device is defined in the independent claim. The other claims define preferred embodiments and applications of the device.

Figure 3:
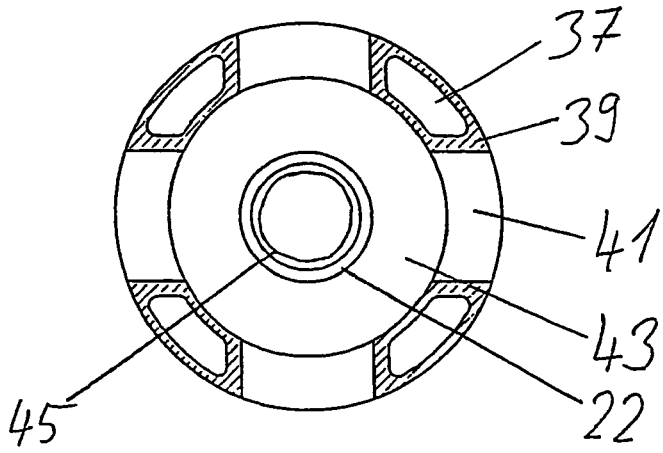
Figure 2:
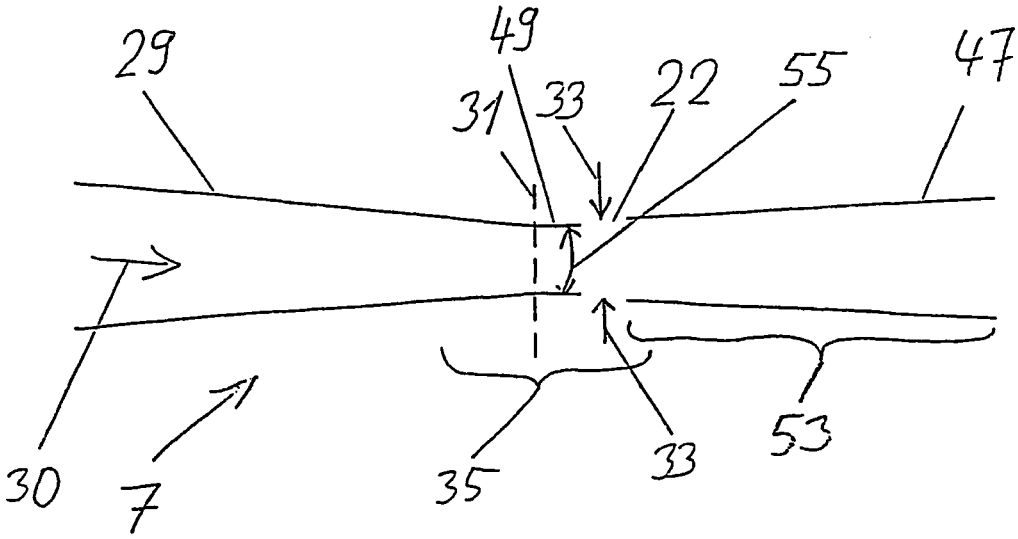
Figure 4:
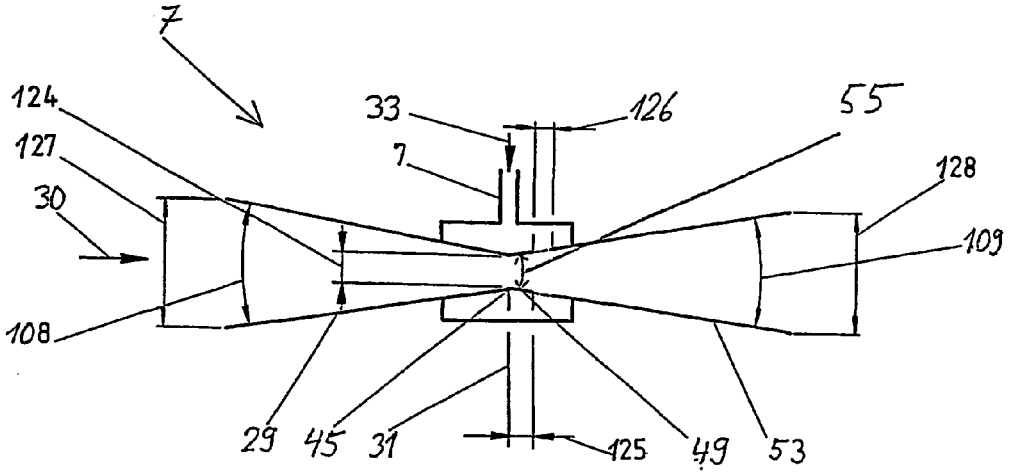
Figure 5:
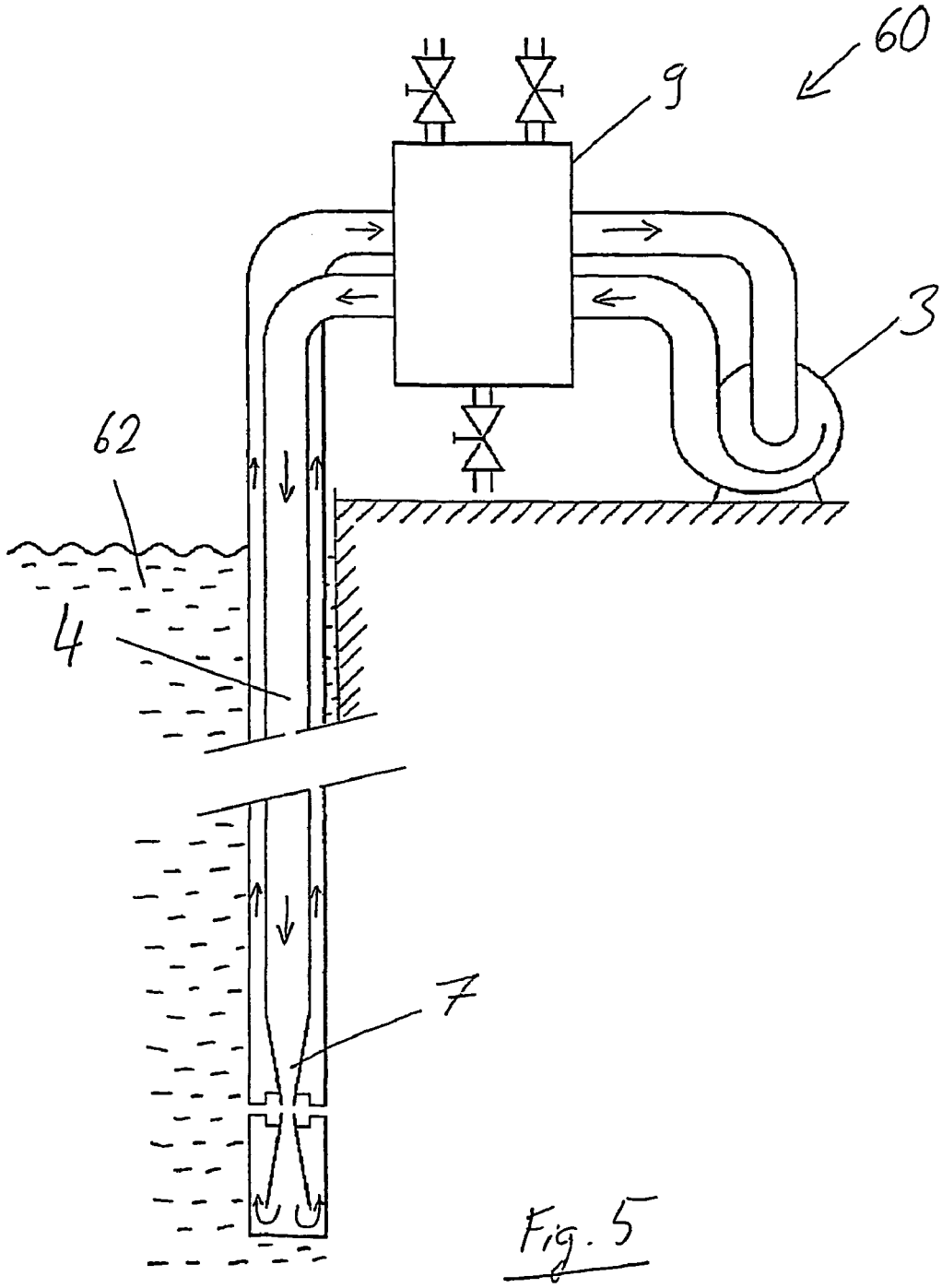

The invention will be explained using exemplary embodiments with reference to the drawings:

FIG. 1 Schema of a pump installation using a DCT device;

FIG. 2 Enlarged schematic longitudinal section of a double-cone unit;

FIG. 3 a cross-cut according to III—III in FIG. 1;

FIG. 4 like FIG. 2, with characteristic parameters;

FIG. 5 a third pump installation (Version C); and

Figure 6:
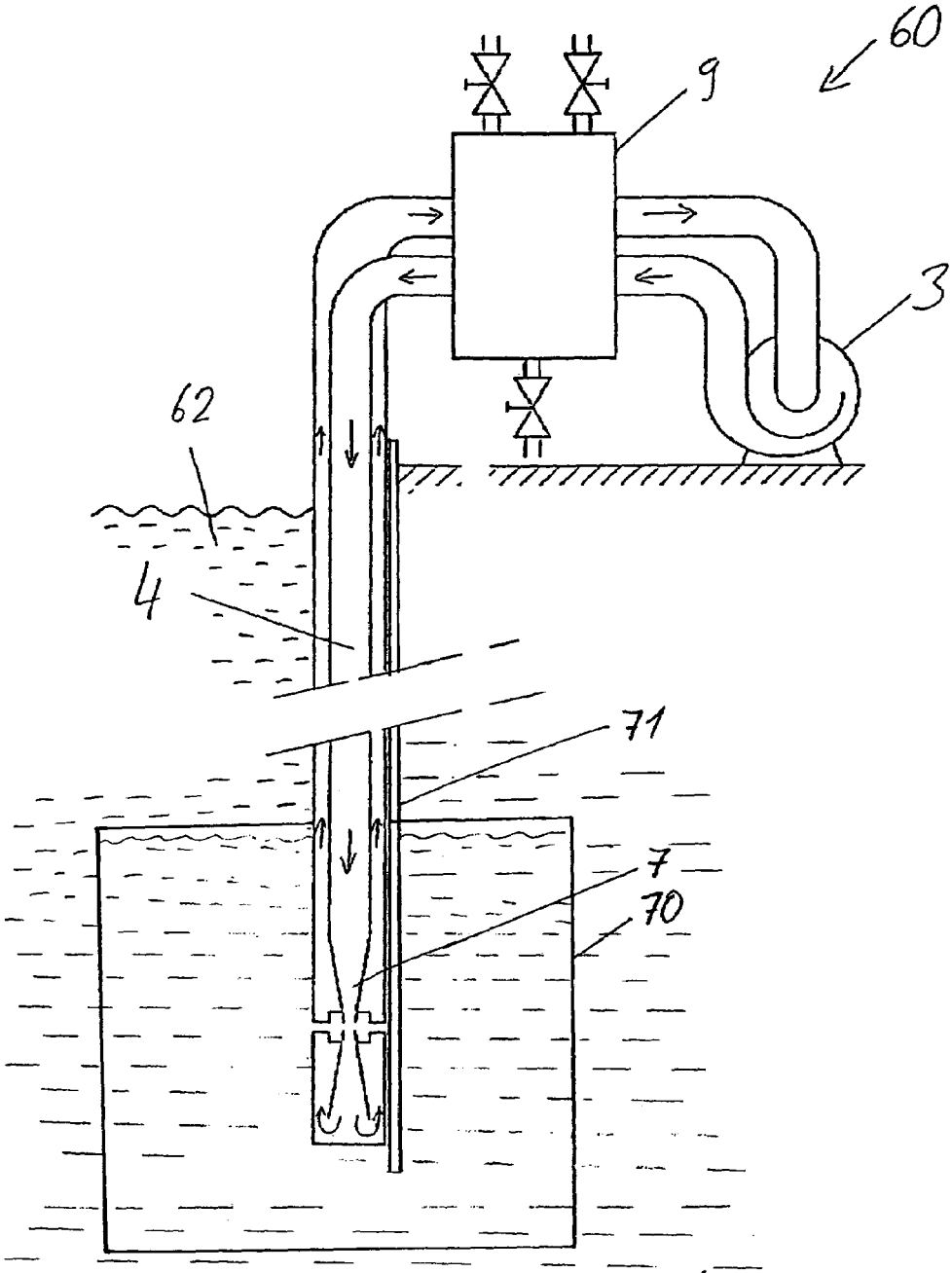

FIG. 6 an arrangement for lifting a sunken object, shown schematically.

DCT devices as used in the present invention are the subject of several earlier patents, e. g. CH-A-669 823, CH-A-671 810, U.S. Pat. No. 4,792,284, EP-B-0 232 391, and the international patent application under the PCT No. PCT/CH 99/0403, which are herewith incorporated by reference.

From these documents, it is known that a DCT device (double-cone technology) constitutes an effective means for producing overpressure and as well a pumping means.

However, with regard to well pump requirements, there exists the problematic situation of the start-up where it would have been expected that pumping fluid pours out of the device into the well. Surprisingly, it has been observed that the pouring out stops a short time after the pumping begins. In other terms, the double-cone device rapidly develops a suction effect overriding the backpressure.

With reference to FIG. 1, a DCT well-pump installation 1 essentially comprises a circulating pump 3, a system of double-walled tubing 4, an open double-cone (ODC) unit 7 and an optional separator unit 9. The circulating pump 3 is placed at the surface 11 in a secure location. It supplies either the inner 13 or outer 15 section of the double-walled tubing 4, which links the pump 3 to the ODC unit 7. The tubing 4 may be rigid, semi-rigid, or flexible. An example of the latter is a fire hose within a fire hose. The ODC unit 7, which is placed at the bottom 17 of the well 19, draws the liquids 20 and/or gases to be pumped through the inlet 22 into the circulating stream 21. The resulting mixture passes directly into the exhaust section 23 of the double-walled tubing and rises to the surface 11 as indicated by upwardly directed arrows 25. This mixture enters the separator 9 at the surface where the carrier liquid is stripped out and returned to the circulating pump 9 (arrow 27).

The ODC unit 7 does not contain any moving parts. Only the carrying liquid and the incoming well material 20 are in a dynamic state. There are no valves in the ODC and it may be started and stopped at will. The only special requirements are that a specific geometry must be respected and that the ODC is made of a suitably resistant material for the environment in which it will be required to function.

The very special mechanical properties of the ODC unit include a capacity to function very well against high backpressures. In fact, the ODC geometry may be chosen so that it functions far more efficiently under situations of high backpressure than without the same. One may profit from this aspect as displayed in the example cited below.

In a well one kilometer deep, it can be expected that the backpressure for a liquid medium will be greater than 100 bar. With the DCT well-pump, the circulating pump is not required to produce this 100 bar, but something of the order of 10 to 20 bar provided that the output delivery is maintained below a specific limit. The missing pressure is supplied by the ODC unit, which has the capacity to convert high flow rates at low pressure to low flow rates at high pressure.

Specific Features of the DCT Well-Pump

The DCT Well-Pump is an unexpected and surprising development of the known DCT high-pressure pump, inter alia according to the initially quoted patents and patent applications. Many of the characteristics of this high-pressure pump carry over to the well-pump. A number of the well-pump's attributes and potential applications are given in the list below.

DCT Well-Pump Characteristics

Technical Characteristics:

1. Will pump gases, liquids and suspensions either individually or as a mixture.
2. Uses a carrier liquid.
3. The carrier liquid may be optimised for any given application.
4. The carrier liquid is driven by a circulating pump whose delivery pressure can be much less than that represented by the depth of the well in terms of static pressure.
5. The pump is not damaged if any of the following situations occurs:
   The outlet is closed.
   The inlet is closed.
   Both outlet and inlet are closed.
6. The down-the-well ODC can function with either a negative or positive gauge pressure applied at its inlet 22.
7. The pump is pulse free.
8. The pump can work against high pressures.
9. The pump may be used for both continuous and batch-wise production.

DCT Well-Pump Layout and Installation Characteristics:

10. The ODC unit 7 can be placed at a great distance from the circulating pump 3.
11. The circulating pump 3 can be placed in a safe location near a power supply, whilst the ODC unit 7 is located at the desired suction point.
12. The overall pump efficiency is an increasing function of the environmental and system pressure in the vicinity of the ODC unit 7.
13. On plunging the ODC unit to a depth well below the surface, FIG. 1, the DCT pump displays a much higher hydraulic efficiency than that obtained with the ODC unit at the surface.
14. A wide range of multi-phase mixtures may be handled, including any mix of the following components:
    Small solid particles;
    Low viscosity sludges;
    Liquids;
    Gases.
15. The entire pump may be set up so that it can be sterilised.

DCT Well-Pump: Advantages in Multi-Phase Pumping:

16. Dangerous mixtures may be pumped.
17. The risk material does not need to be routed through the circulating pump 3, as it may be stripped out in a separator unit 9 and only the carrier liquid returned to the pump 7.
18. The carrier liquid may be chosen so as to "neutralise", or preferentially transport selected fractions.

DCT WELL-PUMP: Operating Principle

First Immersed Version A

A sketch of the DCT Well-Pump operating principle is displayed in FIG. 1. The circulating pump 3 supplies the outer cavity of a double-walled tube that leads to the entrance 29 of the ODC 7 (arrows 30 in FIGS. 1 and 2). On passing through the central portion 31 of the ODC 7 (cf. FIG. 2), a depression is created which draws the well liquid into the carrier stream (arrows 33). This mixture mounts the inner cavity 13 of the double-walled tube 4 and enters the separator 9. After stripping, the carrier liquid is returned to the circulating pump 3 and is recycled.

The material entering the circuit in the input region 35, i.e. through the inlet 22, of the ODC 7 causes the system pressure to rise, enabling a pressurised delivery to be achieved at the output valves of the separator 9. These latter components may be used to control the functioning of the entire system.

The carrier flow through the input region 35 is arranged via passages 37 through the inlet chamber as sketched in FIG. 3 which extend through the external casing 39 of the double-cone unit 7. Liquid and/or gas to be pumped out of the well enters through the four openings 41 in the external casing 39 of the ODC into the suction chamber 43 and is carried away by the carrier as it negotiates the gap (inlet 22) in the central input region 35 a short distance behind the narrowest passage 45 of the double-cone device.

In the interest of simplifying the presentation, only an arrangement of four entry openings 41 are shown in the cross-section of FIG. 3. The actual number and type can be adapted to each specific application.

Any gas drawn into the ODC 7 will be compressed in the main circuit. As the gas rises, the hydraulic pressure decreases and the gas-lift effect will come into operation. On reaching the separator 9, the gas and any other foreign material is stripped from the carrier liquid prior to its return to the circulating pump 3. The solid matter is also removed at the separator.

Specific Details

One of the powerful features of the ODC is that its pressure-drop requirement, at high flow rates, decreases with system pressure up to a specified limit. The upper system pressure limit is itself a function of the carrier flow rate and can be increased to very high values provided that very specific geometric values are respected. In particular, the choice of the small exit diffuser attached to the entry cone is critical. With the correct geometric choice, we find that less energy input is required when comparing ODC operation at depth with that at the surface.

The central orifice region is of critical importance to the functioning of the DCT well-pump. In the patent application PCT/CH 99/00403, a new variation of the original double-cone is proposed. The modification greatly enhances the useable life of the double-cone under extreme conditions and so we include it in the design of the DCT well-pump. Sketches of a longitudinal section through the orifice region of the ODC unit are displayed in FIGS. 2 and 4.

Preferred Values Characterising the Double-Cone Unit With Diffuser

The orifice diameter 124 is represented by d and the small diffuser length 125 by L. The ratio of L to d is critical for the performance of the double-cone device 7. Values of L/d greater than 0.1 display improved life expectancy and overall performance. As the ratio of L/d is increased, the overall pressure-drop across the modified double-cone device 7 decreases. In contrast, the maximum compressor pressure that can be achieved for a given feed flow rate decreases. The optimal trade-off occurs close to the value of L/d which yields just adequate compressor pressure for the available feed flow rate.

Mostly according to PCT/CH 99/00403, other parameters for a particularly advantageous layout of the double-cone device are (≦denotes: smaller or equal to):

Ratio h/d of gap width h 126 to orifice diameter d 124: $0<h/d<6$, preferably $0.5<h/d<4$;

ratio $D_{in}/d$ of entry diameter $D_{in}$ 27 to orifice diameter d: $2<D_{in}/d$, preferably $5<D_{in}/d<20$;

ratio $D_{out}/d$ of entry diameter $D_{out}$ to orifice diameter d: $2<D_{out}/d$, preferably $5<D_{out}/d<20$;

conicity $\theta_1$ 108 of entry cone: $0<\theta_1<10°$ (degree), preferably $\theta_1<8°$, more preferably $\theta_1 \leqq 6°$ conicity $\theta_2$ 109 of exit cone: $\theta_2 \leqq \theta_1$.

According to the present invention, particularly preferred values are: $3° \leqq \theta_1 \leqq 6°$, and/or $\theta_2$ in the range 3° to 6°.

A direct comparison between the performances of the basic double-cone device 1 without diffuser, where the input gap 22 is located at the orifice 45, and the double-cone device 7 with diffuser of FIG. 4 may be derived from the following results:

Working Conditions:

| | |
|---|---|
| Feed flow rate | 8 $m^3$/h |
| Inlet flow rate | 1 $m^3$/h |
| System pressure P | 35 bar |

Observation:

without diffuser: Serious damage after only 20 minutes running time with diffuser: No damage apparent after 40 hours running time In addition to the increased lifetime, the operating noise can be reduced by providing the diffuser.

According to the present invention, particularly for use as a deep-well pump, it has been found, surprisingly, that in varying the conicity of the diffuser, a further significant improvement can be achieved. Therefore, the conicity $\theta_3$ 55 of the diffuser is chosen so that it is greater than 0 and smaller than $\theta_2$, particularly in the range 0.5° to less than 6°, i.e. $0<\theta_3<\theta_2$. Preferred ranges are: $\theta_2$ in the range of 3° to 6°, and $\theta_3$ in the range 1° to 5°.

As already mentioned, by varying the diffuser conicity $\theta_3$ 55, the performance of the double-cone unit is increased, i.e. the power demand of the circulating pump is decreased.

A small DCT well-pump has been run demonstrating an output performance of 0.5 $m^3$/hr (cubic meters per hour) from a simulated well of depth 400 m. The test was carried out on water with the inlet drawing from a reservoir at atmospheric pressure. Both the sizing and performance of the DCT well-pump depend on the well depth, the multi-phase mixture to be pumped, the down-well liquid table, the required output delivery and pressure, as well as the carrier flow rate.

In the immersed version A, FIG. 1, the flow is arranged so that it rises up the inner section of the double-walled tube (arrows 25). For certain applications this arrangement may be preferable over the arrangement according to version B explained below, where the flow of the working circulating fluid is inversed. However, version A does not lend itself easily to the use of flexible tubing.

Immersed Version B

The configuration of the immersed version B is identical to version A, except that the pump connections are interchanged in order to reverse the direction of the circulation of the working fluid. Therefore, for descriptive purposes, FIG. 1 will be referred to with the circulation reversed. Hence, the flow is down the central cavity 13 and up the outer cavity 15. This arrangement is necessary if the double-walled flexible tubing 4 is unable to support an open cross-section when an external pressure is applied to the tubing.

Taking the example of a flexible hose within a flexible hose, it is seen that the start-up situation would probably be impossible if the ODC feed were via the outer lumen 15. The inner tube 13 would close under the pressure and probably not open sufficiently to allow the carrier and its contents to return to the circulating pump 3.

A substantial length of the double-walled tube 4 can be made of flexible material with the rigid ODC 7 attached to one end. The whole set-up can be rolled onto a drum to facilitate manipulation. Whenever regulations permit, the flexible tubing can derive its strength from the well wall.

The walls of the ODC, however, must be capable of withstanding the pressure difference between the internal and external pressures at the bottom of the well.

Start-Up: Immersed Version B

The start-up of a DCT well-pump, following the lowering of the ODC down a well on its double-walled flexible tube, is relatively simple. The circulating pump 3 is started with a supply of carrier liquid from an independent reservoir. The pump drives the carrier liquid down through the inner lumen 13 of the flexible double-walled tube 4 to the orifice 45 of the ODC unit. The orifice 45 represents a much smaller section than the inner lumen and so the liquid will leak out into the well much slower than it arrives in the down pipe. Once the combination of static (column of liquid) and pump pressure has reached a suitable level, the carrier liquid will jet across the gap 22 into the exit cone. At the same time the suction in the inlet region 35 will start. As the carrier liquid fills the outer lumen 15 of the flexible tube and rises towards the surface, the back-pressure on the ODC 7 increases. This effect favours a reduction in ODC pressure-drop, liberating more pressure for increasing the carrier flow rate.

From start-up to circulation stability, the time is normally of short duration. In shallow wells it should be of the order of seconds and in deep wells a few minutes.

Shut-Down: Immersed Version B

The shut-down of the DCT well-pump only requires the switching off of the circulating pump 3. The carrier liquid in the flexible double-walled tubing 4 will tend to run down into the well, but should not cause any undue complication for most applications. The loss of carrier liquid to the well can be reduced by the introduction of valves into the supply and return tubing in the region of the separator 9.

Unblocking the ODC Unit

The material drawn into the ODC 7 may periodically block the unit. One possibility is to reverse the flow direction of the feed to the ODC 7. This will create a high pressure in the inlet region 29 tending to blow out the blocking material. Once the delivery pressure is seen to have substantially decreased the feed can be returned to its normal direction. The high pressure created by the flow inversion through the ODC 7 is guaranteed by the asymmetric geometry displayed in FIG. 2.

DCT Well-Pump: Immersed Version C

The immersed version C 60, shown in FIG. 5, allows the continuous pumping of liquid 62 from great depths. This particular arrangement is extremely efficient and, as such, is capable of pumping large quantities of liquid using relatively small-sized ODC units 7.

As mentioned before, the higher the system and applied inlet pressure, the more circulating liquid that will pass for a given pressure-drop across the ODC unit 7. 1000 m below the surface the system pressure will be greater than 100 bar under dynamic conditions with 100 bar applied inlet pressure. For such conditions an extremely efficient ODC 7 can be designed.

A demonstration version of such a pump was tested in Lake Thun in Switzerland at a depth of 40 m. The experiment not only proved the principle, but also demonstrated the promise for industrial applications.

Immersed Version C: Flotation Aid

As shown in FIG. 6, a separate small-bore pipe 71 may be lowered and attached to a sunken object 70. Using immersed version C, the DCT Well-Pump could be lowered and attached to the sunken object 70, that carries the small-bore pipe 71, so as to draw water out of it. On running the well pump, air will gradually descend the small-bore pipe 71 and fill the progressively evacuated sunken object 70. After a while, the enhanced displacement volume will cause the sunken object 70 to rise in a controlled manner towards the surface.

Virtual Shut-down, All Versions

A virtual shut-down with minimal or no leaking of the circulation fluid is obtained by simply reducing the circulating pump's power and/or closing the output valves 36. Of course, if only the output valves 36 are closed, a considerable overpressure builds up within the circuit until an equilibrium may be reached.

General Appearance and Typical Dimensions of the ODC

The ODC, when viewed from the outside, has the appearance of a cylinder with holes arranged around the circumference some halfway along the cylinder's axis. At one end there is an attachment for the tubing 4 and at the other end the cylinder is blanked off. Typical dimensions for a small-bore well ODC are 150 cm long with an external section diameter of 100 mm.

Preferably, the closing of the lower end of the double-cone unit 7 is just a plane disc. It has been found that a shape supporting the reflection of the circulating stream merely deteriorates the performance. However, this finding does not strictly exclude other means for closing the ODC unit.

Projected Performance of a Small DCT Well-Pump

On considering a well 400 meters deep that is accessed by means of a 110 mm diameter bore-hole, it is reasonable to use an ODC of external diameter 100 mm and some 150 cm long. Within such an ODC external casing a number of distinct internal geometries may be envisaged. In Table 1 below the theoretical performances for three geometries differing in L/d values are summarised.

TABLE 1

Comparative performances for 3 ODC units with different L/d values that fit into the same cylindrical casing (external dimensions: 150 cm long with a diameter of 100 mm).

| ODC geometry Type | Liquid delivered to surface from well 400 m deep L/sec | Barrels/day | Carrier flow rate L/sec | Required pump delivery pressure bar | DCT Well-Pump hydraulic efficiency % |
|---|---|---|---|---|---|
| 1 | 1.05 | 571 | 15.6 | 11.2 | 24.2 |
| 1 | 1.54 | 838 | 17.2 | 12.2 | 29.4 |
| 1 | 2.13 | 1157 | 20.2 | 13.8 | 30.6 |
| 2 | 1.05 | 571 | 16.5 | 8.4 | 30.4 |
| 2 | 1.56 | 847 | 18.6 | 9.3 | 35.9 |
| 2 | 2.01 | 1092 | 21.3 | 10.4 | 36.2 |
| 3 | 1.14 | 619 | 17.5 | 8.5 | 30.6 |
| 3 | 1.56 | 847 | 18.4 | 9.0 | 37.4 |
| 3 | 2.03 | 1104 | 20.1 | 9.8 | 41.3 |

These theoretical results do not represent the best cases. They are only included so as to situate the scale of performance of a typical, small bore, DCT Well-Pump. The hydraulic efficiency can be increased well beyond the best value presented in Table 1. However, other criteria often overshadow efficiency when difficult conditions come into play. The energy requirement to drive the circulating pump for the least efficient situation cited above is equivalent to less than 1 barrel of oil per day. In fact, the efficiencies shown are well above those of even the best jet pumps.

Following the description set out above, one skilled in the art is enabled to perceive variants that lie within the scope of the protection conferred by the claims. For example, one may think of the following:

Instead of the improved double-cone device, a simple double cone device may be used. i.e. one with the input openings 22 arranged at the narrowest passage.

Separate tubes may be used for the supply and draining of the circulating fluid, e.g. by tilting or, in the extreme case, by the horizontal arrangement of the double-cone unit.

The virtual extension of the exit cone may not meet exactly the circumference of the orifice (45) of the double cone device, but may cut the plane 31 with a smaller or a larger diameter.

The invention claimed is:

1. Double-cone device for creating a pressure difference in a fluid penetrating the device, the device essentially consisting of an entry unit and an exit unit, each of essentially hollow frustroconical shape, and the entry unit and the exit unit being connected by their respective first ends of small diameter creating an orifice, wherein at least one first inlet opening is provided in the exit unit in a distance from its first end, so that between the inlet opening and the first end of the exit unit a diffuser section of increasing cross-cut and an effective length L exists in order to decrease noise and/or wear of the double-cone device, wherein the diffuser section provides a conicity less than that of the exit cone.

2. Double-cone device according to claim 1, wherein the conicity of the exit cone is greater than 0° and at most 10°.

3. Double-cone device according to claim 2, wherein the conicity of the exit cone is smaller than 8°.

4. Double-cone device according to claim 2, wherein the conicity of the exit cone is in the range of from 3° to 6°.

5. Double-cone device according to claim 1, wherein the conicity of the diffuser section is greater than 0°.

6. Double-cone device according to claim 5, wherein the conicity of the diffuser section is in the range of from 1° to 5°.

7. Double-cone device according to one of claim 1, wherein the wall of the double-cone device comprises at least one channel and that the double-cone device is closed at a first end of it, the channel having an opening at the first end and at the other second end of the double-cone device, so that a liquid is movable through the channel to or away from the closed end, and drain and supply conduit are attachable at the second end of the double-cone device, one to the channel , the other to the second end of the entry or exit unit of the double-cone device.

8. A pump arrangement for pumping liquids including gases from great depths, the arrangement comprising a circuit for a working fluid, wherein the circuit comprises a supply conduit, a drain conduit, a circulating pump device, a double cone unit and means for discharging the pumped liquid, which are connected to allow a circulating fluid to circulate through the pump device, the supply conduit, the double-cone device, and the drain conduit, and the discharge means being arranged within one of the said conduits so that the pumped liquid inserted by the double cone into the circulating fluid stream can be recovered by the discharge means wherein the double-cone device essentially consists of an entry unit and an exit unit, each of essentially hollow frustroconical shape, and the entry unit and the exit unit being connected by their respective first ends of small diameter creating an orifice, wherein at least one first inlet opening is provided in the outlet unit in a distance from its first end, so that between the inlet and the first end of the exit unit a section of increasing cross-cut and an effective length L exists in order to decrease noise and/or wear of the double-cone device.

9. A pump arrangement according to claim 8 with a double-cone device for creating a pressure difference in a fluid penetrating the device, the device essentially consisting of an entry unit and an exit unit, each of essentially hollow frustroconical shape, and the entry unit and the exit unit being connected by their respective first ends of small diameter creating an orifice, wherein at least one first inlet opening is provided in the exit unit in a distance from its first end, so that between the inlet opening and the first end of the exit unit a diffuser section of increasing cross-cut and an effective length L exists in order to decrease noise and/or wear of the double-cone device, wherein the diffuser section provides a conicity less than that of the exit cone.

10. A pump arrangement according to claim 9, wherein the conicity of the exit cone is greater than 0° and at most 10°.

11. A pump arrangement according to claim 10, wherein the conicity of the exit cone is smaller than 8°.

12. A pump arrangement according to claim 10, wherein the conicity of the exit cone is in the range of from 3° to 6°.

13. A pump arrangement according to claim 10, wherein the conicity of the diffuser section is greater than 0°.

14. A pump arrangement according to claim 13, wherein the conicity of the diffuser section is in the range of from 1°to 5°.

15. A method for lifting objects sunk in a liquid with the pump arrangement according to claim 8, wherein the liquid is pumped out of the objects by the pump device, and a medium of smaller specific weight is guided by an additional conduit to the object, so that the medium occupies the volume of the pumped out liquid and the displacement of the sunken object is enhanced.

16. A method according to claim 15, wherein the medium of smaller specific weight is a gas.

17. A pump arrangement according to claim 8, wherein the arrangement is adapted for pumping liquids, including gasses, from a well.

18. A pump arrangement according to claim 17, wherein the well is an oil well.

19. A pump arrangement according to claim 13, wherein the wall of the double-cone device comprises at least one channel and that the double-cone device is closed at a first end of it, the channel having an opening at the first end and at the other second end of the double-cone device, so that a liquid is movable through the channel to or away from the closed end, and drain and supply conduit are attachable at the second end of the double-cone device, one to the channel, the other to the second end of the entry or exit unit of the double-cone device.

* * * * *